US007295168B2

(12) United States Patent
Saegusa et al.

(10) Patent No.: US 7,295,168 B2
(45) Date of Patent: Nov. 13, 2007

(54) ANTENNA COIL

(75) Inventors: Seiichiro Saegusa, Yonezawa (JP); Hitoki Nakaya, Sakura (JP); Takayuki Ochi, Yonezawa (JP); Shigeyoshi Seino, Yonezawa (JP)

(73) Assignee: Yonezawa Electric Wire Co., Ltd., Yonezawa (JP)

( * ) Notice: Subject to any disclaimer, the term of this patent is extended or adjusted under 35 U.S.C. 154(b) by 0 days.

(21) Appl. No.: 11/129,017

(22) Filed: May 13, 2005

(65) Prior Publication Data

US 2005/0270249 A1 Dec. 8, 2005

(30) Foreign Application Priority Data

May 20, 2004 (JP) ..... P2004-150356
Dec. 17, 2004 (JP) ..... P2004-366117

(51) Int. Cl.
*H01Q 7/08* (2006.01)

(52) U.S. Cl. ..... 343/788; 343/866; 343/787

(58) Field of Classification Search ..... 343/878, 343/866, 867; 29/600
See application file for complete search history.

(56) References Cited

U.S. PATENT DOCUMENTS 6,367,143 B1 * 4/2002 Sugimura ..... 29/602.1
7,042,411 B2 * 5/2006 Yagi et al. ..... 343/788
2002/0017569 A1 * 2/2002 Iiyama et al. ..... 235/492
2005/0151696 A1 * 7/2005 Govari et al. ..... 343/788
2006/0152427 A1 * 7/2006 Ueda et al. ..... 343/788
2006/0227060 A1 * 10/2006 Hess et al. ..... 343/788

FOREIGN PATENT DOCUMENTS

| | | |
|---|---|---|
| JP | 08-274682 | 10/1996 |
| JP | 2003-092509 | 3/2003 |
| JP | 2003-249816 | 9/2003 |
| JP | 2004-032754 | 1/2004 |

* cited by examiner

*Primary Examiner*—Trinh Vo Dinh
(74) *Attorney, Agent, or Firm*—Cohen Pontani Lieberman & Pavane LLP

(57) ABSTRACT

An antenna coil has a simple structure and a high sensitivity and can be thinner. The antenna coil includes an X Y coil unit having an X axis coil and a Y axis coil wound around a core, a Z axis coil wound around the X Y coil unit, and a resin portion insert molded around the X Y coil unit and the Z axis coil. In the antenna coil, the X axis coil, the Y axis coil, and the Z axis coil are arranged so that the three coils have an axis in a direction orthogonal to each other, and the X Y coil unit and the Z axis are integrated by the resin portion.

4 Claims, 6 Drawing Sheets

ANTENNA COIL

PRIORITY CLAIM

Priority is claimed on Japanese Patent Application Nos. 2004-150356, filed May 20, 2004, and 2004-366117, filed Dec. 17, 2004, the content of which is incorporated herein by reference.

BACKGROUND OF THE INVENTION

1. Field of the Invention

The invention relates to an antenna coil that is used, for example, in a keyless entry system for motor vehicles.

2. Description of Related Art

Previously, techniques were known for electronic key systems for motor vehicles. The techniques include an antenna coil in an IC card (a transceiver on a portable side) as an electronic key. The antenna coil is electromagnetically coupled to the antenna coil of an IC card in a card reader (a transceiver on an external side) of a motor vehicle. The antenna of the card reader on the motor vehicle side transmits an inquiry signal in the air. When the antenna coil of the IC card receives the inquiry signal, the IC card sends out an ID code signal characteristic of each vehicle as a response signal from the antenna coil. The card reader reads the ID codes from the IC card to compare the ID codes with ID codes beforehand on the vehicle side. When both of the codes are matched, some operations such as a door lock or start-up of an engine are performed, which is a known technique, for example, in Japanese Patent Publication (Laid Open) Hei 8-274682.

In recent years, in order to obtain nondirectional reception sensitivity, a three-axis antenna coil having three coils, where a direction orthogonal to the others is determined to be an axis, have been proposed. As for the three-axis antenna coil, considering downsizing and portability of the device, the three coils have to be positioned as effectively as possible, taking up as small an area as possible.

As examples, Japanese Patent Publications (Laid Open) 2003-92509 and 2004-32754 disclose that the X axis coil and Y axis coil are wound around a spool of a core, with the insulating spool located so as to encircle the X axis and Y axis coils, where a z axis coil is wound around the spool.

Japanese Patent Publication (Laid Open) 2003-249816 discloses the antenna coil, where concave portions for a cross winding are formed in four sides of a core of a flat plate, outer circumference grooves for the winding are provided in an outer circumference of the concave portions for the winding, the X axis coil and Y axis coil are wound in the concave portions for winding, and the Z axis coil is wound in the outer circumference grooves for the winding.

The three axis antenna coil of the prior art provides concave portions such as grooves in the core or spool mounted around thereof. In the concave portions, the coils are wound and held. However, in order that the coils do not come off the core or spool, the depth of the concave portions is larger than the thickness of layers which the wound coils constitute. In other words, an overhang is formed that overhangs from the outer surface in the circumference of the concave portions, which is disadvantageous in making the antenna coil smaller or thinner. Since a shape of the core or spool is complicated to hold the coils in the concave portions, it takes time and labor to wind the coils around the core or spool, which produces a problem of incurring increased manufacturing cost.

According to the inventions described in Japanese Patent Publications 2003-92509 and 2004-32754, electrodes (terminals), to which lead terminals for the coils are connected, are mounted to an upper and a lower surface of the spool, which is disadvantageous in reducing thickness of an antenna coil because the thickness of the antenna coil increases. Since a portion connecting the lead terminal and the electrode overhangs from the spool, the electrode is subject to coming off or being damaged when an impulse is applied.

Furthermore, when this kind of antenna is mounted on a printed board, if a wiring pattern formed on the printed board or a conductor such as an electronic component is provided beneath the antenna coil, an inductance of the coil and a value of Q are lowered, which deteriorates sensitivity of the antenna. Because of this, an empty region in which there is no wiring pattern or electronic component is formed on the printed board, and in the empty region, an antenna coil is placed. However, in this case, it is difficult to reduce an area for mounting the antenna coil.

For the foregoing reasons, there is a need for an antenna coil that has a simple structure and a high sensitivity, and in addition has a small thickness.

Furthermore, for the foregoing reasons, there is another need for an antenna coil that has can reduce a mounting area on a printed board where the antenna coil is provided on the printed board.

SUMMARY OF THE INVENTION

The present invention relates to an antenna coil that satisfies the need. The antenna coil comprises an X Y coil unit having an X axis coil and a Y axis coil wound around a core, a Z axis coil wound around the X Y coil unit, and a resin portion insert molded around the X Y coil unit and the Z axis coil. In the antenna coil, the X axis coil, the Y axis coil, and the Z axis coil are arranged so that the three coils have an axis in a direction orthogonal to each other, and the X Y coil unit and the Z axis are integrated by the resin portion.

The antenna further comprises a plurality of electrodes provided on the resin portion. The electrodes are fixed by a insert molding on the resin portion, with a portion of each electrode exposed to an outside of the resin portion, and are connected to each terminal of the three coils.

In the antenna coil, the Z axis coil is fixed to the X Y coil unit by an adhesive in the resin portion.

Furthermore, the present invention is directed to an antenna coil provided on a printed board that satisfies the need. The antenna coil comprises a core provided on one side of the printed board and around which a coil is wound; and a magnetic shield layer provided on a lower surface of the coil, including nonmetallic magnetic powder, the lower surface of the coil being on a side of the printed board.

Preferably, the magnetic shield layer is formed by self-fusion of nonmetallic magnetic powder having self-fusing film or compound containing nonmetallic magnetic powder and adhesive resin.

Preferably, the antenna coil comprises at least two legs for supporting the core on the printed board, below a portion of the core wound by the coil.

Advantageously, the upper surface of the coil includes coating film by resin powder coating.

Advantageously, the antenna coil comprises a terminal to be connected to the end of the coil, the terminal being formed by a metallic plate layer.

According to the invention, since the X Y coil unit and the Z axis coil are integrated by the resin portion insert-molded in the circumference of the X Y coil unit and the Z axis coil, the structure of the antenna coil can be more simplified than that in the past. Because the coil is held by the resin portion molded outside the coil, not by a core provided inside the coil as in the past, the antenna coil can be made smaller and thinner.

Since the electrodes, to which each terminal of the coils is connected, are attached to the resin portion by the insert molding, those electrodes can be fixed without an increase in thickness of the antenna coil, which contributes to rendering the antenna coil thinner. In addition, since a connecting portion between the lead terminal and the electrode can be imbedded in the resin portion, antenna coils can be produced so that the coils can have excellent durability to impulses or external forces.

Because the Z axis coil is attached to the X Y coil unit by an adhesive inside the resin portion, the Z axis coil is fixed, keeping a positional relationship between the Z axis coil and the X Y coil unit beforehand prior to the insert-molding. This improves workability of the manufacturing process.

Furthermore, according to the antenna coil of the present invention, even if conductors such as electronic components or wiring pattern formed on the printed board exist below the antenna coil, the magnetic shield layer composed of non-metallic magnetic powder provided on the lower surface of the coil controls the lowering of the inductance of the coil and the value of Q. Because of this, maintaining antenna sensitivity, a mounting area for the antenna coil on the printed board can be reduced.

DETAILED DESCRIPTION OF THE INVENTION

The preferred embodiment of the invention will be described referring to the figures.

Figure 1:
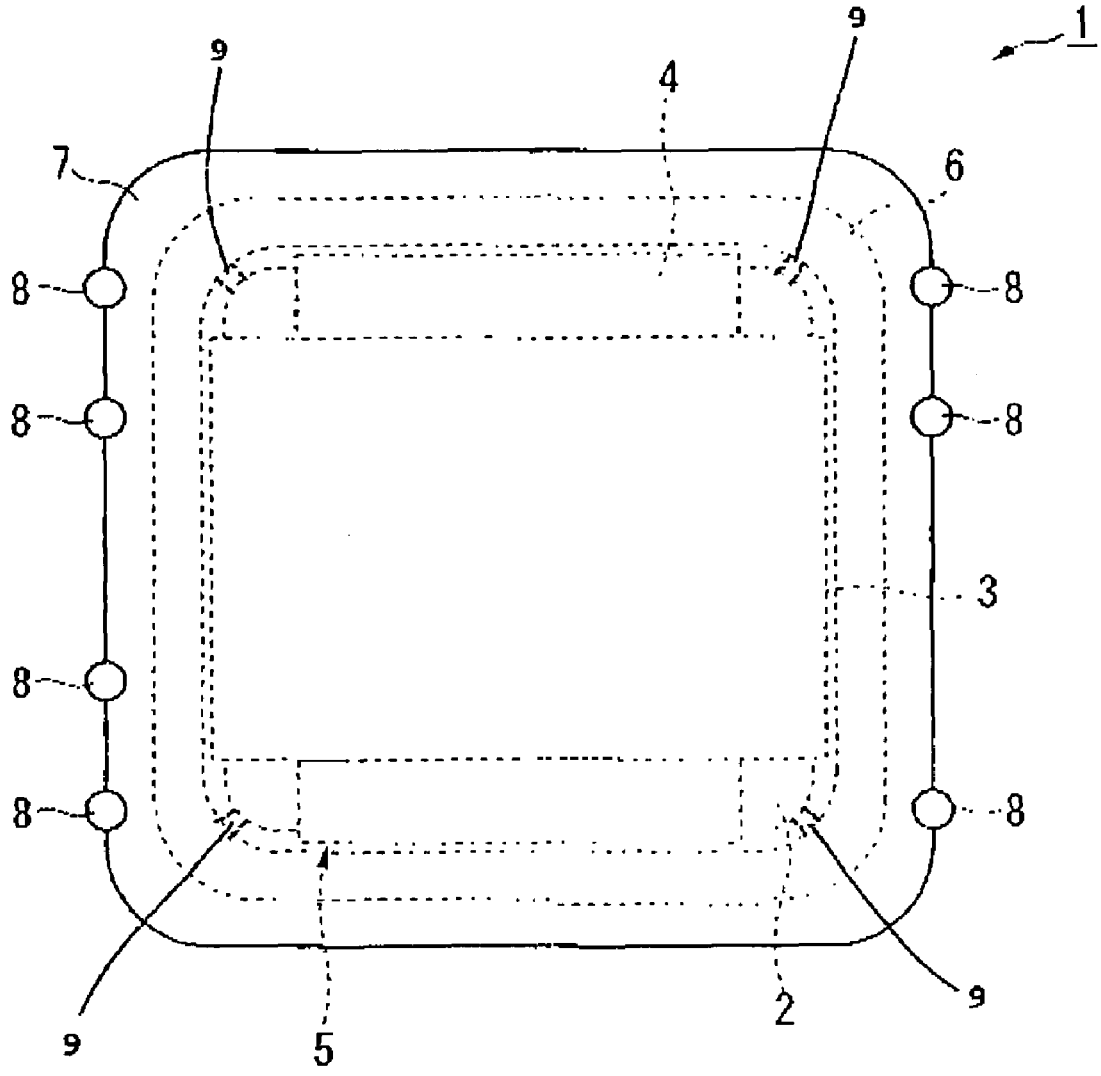
FIG. 1 is a bird's eye view of an antenna coil of one embodiment in accordance with the invention.
Figure 2A:
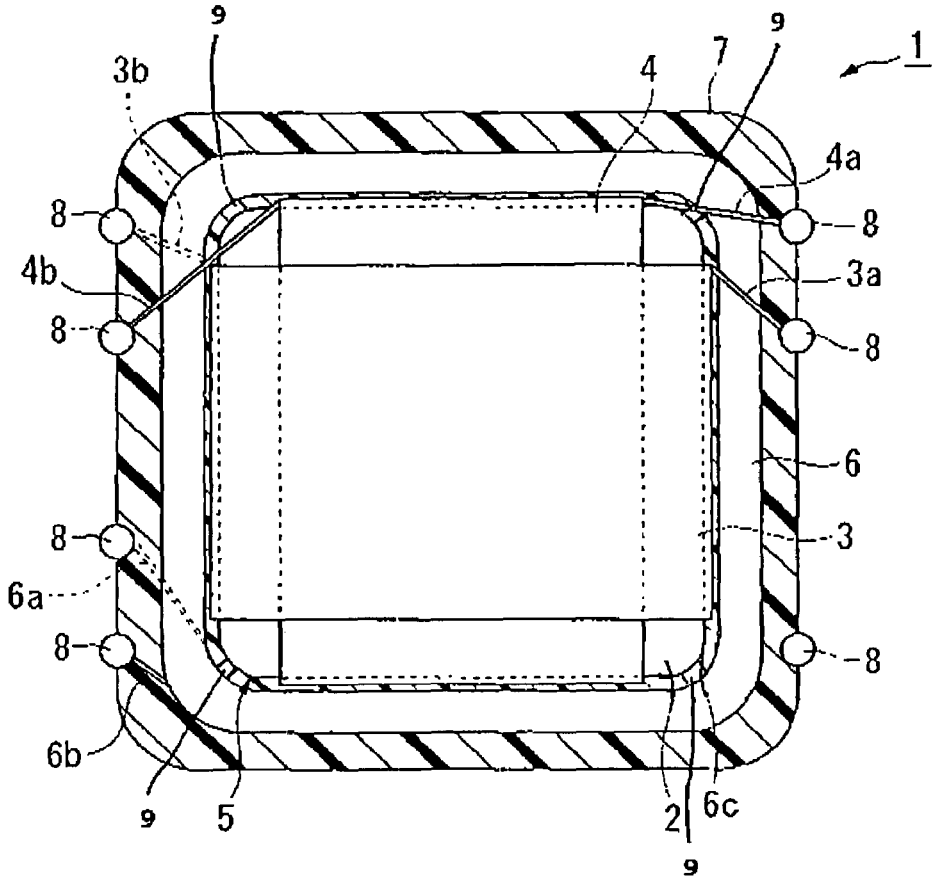
FIG. 2A is a plan cross-sectional view of the antenna coil shown in FIG. 1.
Figure 2B:
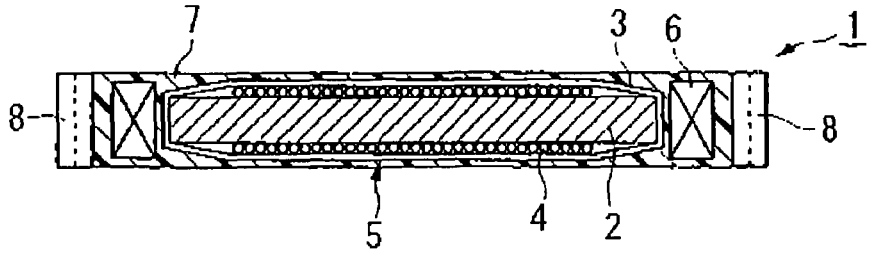
FIG. 2B is a front cross-sectional view of the antenna coil shown in FIG. 1.

FIG. 1 is a bird's eye view of an antenna coil of one embodiment in accordance with the invention. FIG. 2A is a plan cross-sectional view of the antenna coil shown in FIG. 1. FIG. 2B is a front cross-sectional view of the antenna coil shown in FIG. 1.

As shown in FIGS. 1, 2A, and 2B, an antenna coil 1 in accordance with the embodiment includes an X Y coil unit 5 and a Z axis coil 6. The X Y coil unit 5 includes an X axis coil 3 and a Y axis coil 4 that are wound around a core 2, and the Z axis coil 6 is wound around the X Y coil unit 5. The X Y coil unit 5 and the Z axis coil 6, around which a resin portion 7 is formed by insert molding, are integrated by the resin portion 7 to constitute the antenna coil 1.

Figure 4A:
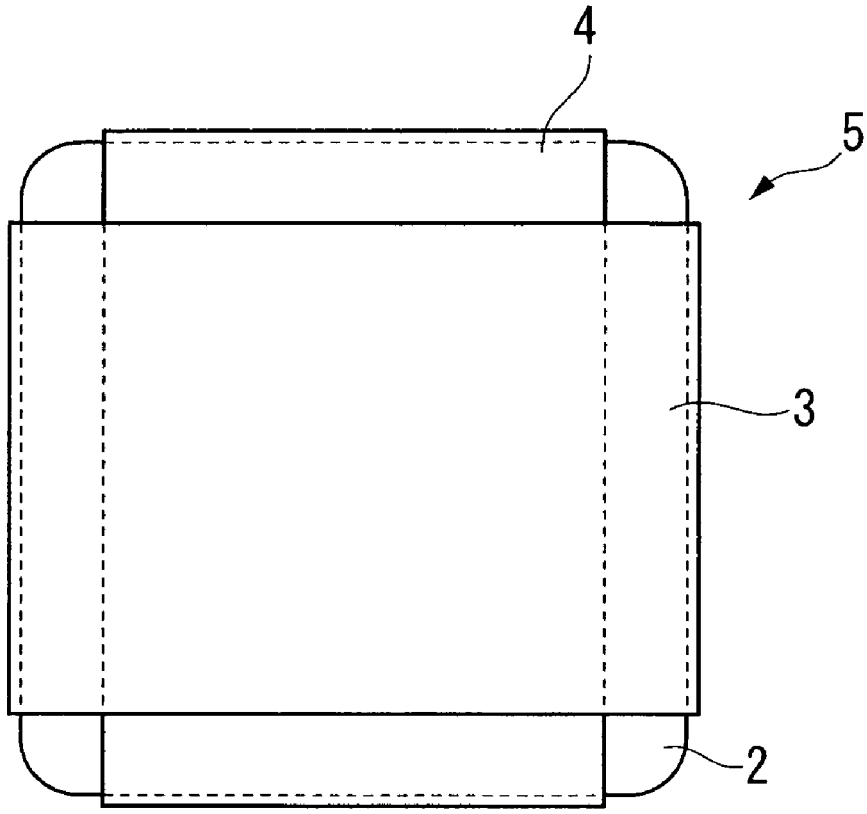
FIG. 4A is a plan view of an X Y coil unit in the antenna coil of FIG. 1.
Figure 4B:
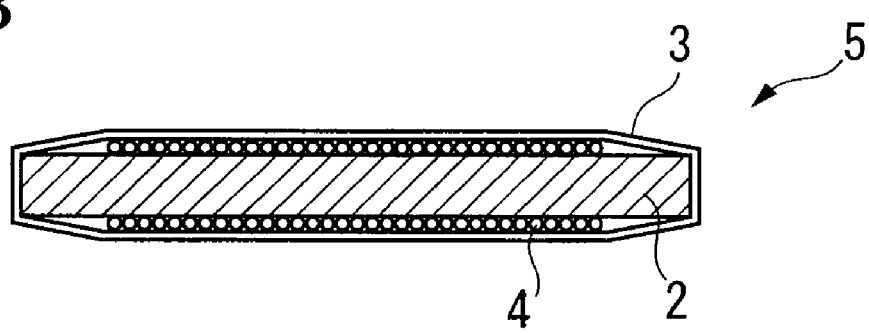
FIG. 4B is a front cross-sectional view of the X Y coil unit in the antenna coil of FIG. 1.

FIG. 4A is a plan view of an X Y coil unit in the antenna coil of FIG. 1. FIG. 4B is a front cross-sectional view of the X Y coil unit in the antenna coil of FIG. 1. As shown in FIGS. 4A and 4B, the coil unit 5 is wound around the rectangular core 2 in the direction where the X axis coil 3 and Y axis coil 4 are orthogonal to each other. In the embodiment, the core of a solid plate is used as the core 2. Soft magnetic material such as ferrite or amorphous alloy can be used as the material for the core 2.

Figure 3A:
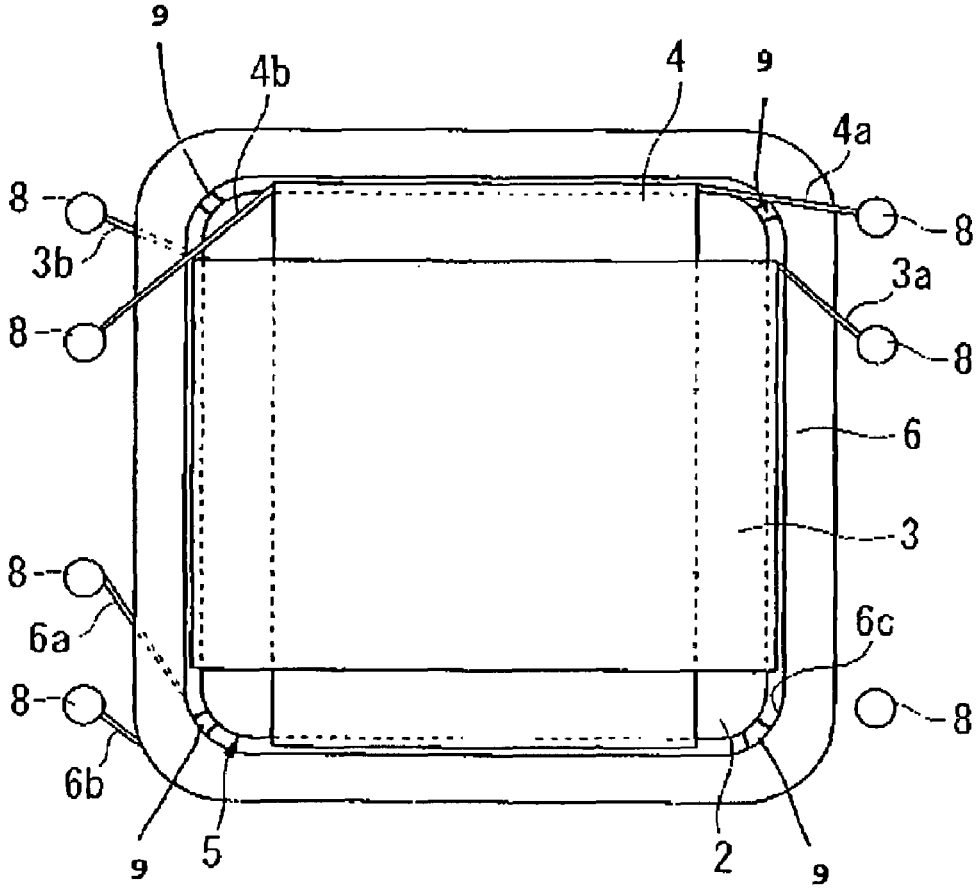
FIG. 3A is a plan view of the antenna coil of FIG. 1 without a resin portion.
Figure 3B:
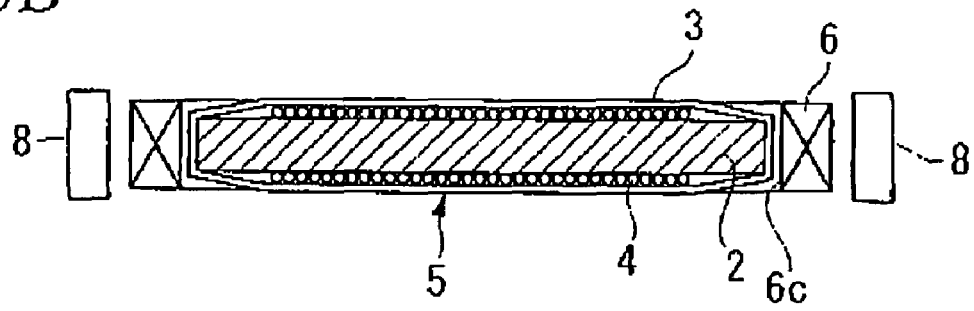
FIG. 3B is a front cross-sectional view of the antenna coil of FIG. 1 without a resin portion.

FIG. 3A is a plan view of the antenna coil of FIG. 1 without a resin portion. FIG. 3B is a front cross-sectional view of the antenna coil of FIG. 1 without a resin portion. The Z axis coil 6 is an air-core coil with conductive leads wound in a circle. As can be understood from FIGS. 3A and 3B which do not show the resin portion 7, the X Y coil unit 5 is held in a hollow portion 6*c* of the Z axis coil 6. Around the X Y coil unit 5 and the Z axis coil 6, the resin portion 7 is formed so as to integrate the X Y coil unit 5 and the Z axis coil 6 by the insert molding. As the resin portion 7, for example, thermoplastic resin or thermoset resin can be used.

In FIG. 1, the X Y coil unit 5 and the Z axis coil 6 are embedded in the resin portion 7. The structure of the figure is favorable because the resin portion 7 can be a coating that protects coils 3, 4, and 6. In the invention, coils 3, 4, and 6, and/or a portion of the core 2 may be exposed to the outside of the resin portion 7.

The three coils including the X axis coil 3, the Y axis coil 4, and the Z axis coil 6 are arranged so that the direction mutually orthogonal can be an axis. According to this, the antenna coil of the embodiment can function as a nondirectional three axis antenna coil for receiving signals from an arbitrary direction in three dimensions, and have high reception sensitivity.

Prior to the insert molding, by the use of an adhesive 9, the X Y coil unit 5 and the Z axis coil 6 are adhered and fixed. In this case, since the positional relationship between X Y coil unit 5 and the Z axis coil 6 can be fixed beforehand prior to the insert molding, workability in the manufacturing process can be improved.

Both terminals 3*a* and 3*b* of the X axis coil 3, both terminals 4*a* and 4*b* of the Y axis coil 4, and both terminals 6*a* and 6*b* of the Z axis coil 4 are connected to electrodes 8 fixed at the outer circumference of the resin portion 7, respectively. The shape of the electrodes 8 is not limited, for example, to a cylinder as shown in the figure or a prism. One part of the electrode 8 is embedded in the resin portion 7, and another part is exposed to the outside of the resin portion 7.

There is one method of fixing the electrodes 8 onto the resin portion 7 in which when the resin portion 7 is insert-molded around the X Y coil unit 5 and the Z axis coil 6, the insert molding can be performed together. In order that the resin portion 7 and the electrodes 8 are greatly adhered by the insert molding and do not loosen, it is preferable that concaves (not shown) on the surface of the electrodes, into which molten resin can invaginate, are formed to have the resin portion 7 enter into the concaves of the electrodes 8, or that concaves or convexes by knurling process on the surface of the electrodes 8 are formed to have a larger contact area between the resin portion 7 and the electrodes 8.

Connections between each terminal of 3*a*, 3*b*, 4*a*, 4*b*, 6*a*, and 6*b* of the coils 3, 4, and 6 and the electrodes 8 are made, respectively, for example, by spot welding using laser welding or resistance welding It is preferable that the connections be buried in the resin portion 7, which can produce an excellent antenna coil having larger durability to impulses or external forces.

On example of the steps for manufacturing the antenna coil 1 of the embodiment will be explained below.

As shown in FIGS. 4A and 4B, an X Y coil unit 5, where an X axis coil 3 and Y axis coil 4 are wound around a core 2, is manufactured. The X axis coil 3 and a Y axis coil 4 are made in a manner that an air-core coil is inserted into the core 2 or leads are wound around the core 2.

Next, as shown in FIG. 3, the X Y coil unit 5 is inserted into a hollow portion 6*c* of a Z axis coil 6. Three coils 3, 4, and 6 are arranged so that the coils have an axis in a direction orthogonal to each other. The X Y coil unit 5 and Z axis coil 6 are put in a molding tool. Then, as shown in FIG. 2, a resin portion 7 is formed at the circumference by insert molding.

Electrodes 8 can be connected with terminals 3*a*, 3*b*, 4*a*, 4*b*, 6*a* and 6*b* of the coils 3, 4, and 6, respectively, prior to the insert molding. Alternatively, the terminals 3*a*, 3*b*, 4*a*, 4*b*, 6*a* and 6*b* of the coils 3, 4, and 6 are drawn beforehand to be exposed from the resin portion 7 when formed, which enables the terminals 3*a*, 3*b*, 4*a*, 4*b*, 6*a* and 6*b* to be connected with the electrodes 8 after the insert molding.

When the antenna coil 1 is used as a data transmitting and receiving card antenna for a portable electronic key, the antenna coil 1 is embedded into an IC card for use, together with a control unit that also has a function of a memory unit storing an ID code signal characteristics to a vehicle.

An electronic key system for a vehicle utilizing the data transmitting and receiving card antenna includes the three-axis antenna coil 1 having an X axis coil, a Y axis coil and a Z axis coil in an IC card as an electronic key. The antenna coil is electromagnetically coupled to the data transmitting and receiving card antenna of the IC card in a card reader on the vehicle side (a transceiver on an external side). When a distance between a vehicle and an IC card are within a predetermined range, an inquiry signal from the antenna coil of the card reader on the vehicle side is transmitted as an electromagnetic induction signal that is an air propagating signal.

At this time, electric power for driving the IC card is also sent. When the inquiry signal is received by the three axis type of data transmitting and receiving card antenna for the IC card, an ID code signal, which is stored in the control unit of the IC card, characteristic to the vehicle, is transmitted as an electromagnetic induction signal that is an air propagating signal, as a response signal from the data transmitting and receiving card antenna.

The card reader reads the ID code transmitted by the IC card, and compares the ID code read in with an ID code stored beforehand on the vehicle side. When both agree, some operations such as locking and/or unlocking a door or starting up an engine are supposed to be performed.

According to the embodiment, since the X Y coil unit and the Z axis coil are integrated by the resin portion insert-molded in the circumference of the X Y coil unit and the Z axis coil, the structure of the antenna coil can be simpler than that in the past. Because the coil is held by the resin portion molded outside the coil, not by a core provided inside the coil as in the past, the antenna coil can be made smaller and thinner. As an inner space of the antenna coil is made maximum and effective use of, thick leads having a large cross sectional area can be used as coil leads, which can contribute to improvement of reception sensitivity.

Spools of complicated shape that are exemplified in the prior art are unnecessary. Instead, the spool can be manufactured by inserting an air-core coil into the circumference of the core and insert-molding the resin along the circumference. This can improve productivity and realize low price.

According to the structure by which the electrodes, to which each terminal of the coils is connected, are attached to the resin portion by the insert molding, the electrode can be fixed without increasing the thickness of the antenna coil. This is advantageous to making the antenna coil thinner. In addition, as the portions connecting between the lead terminal and the electrode can be embedded in the resin portion, antenna coils can be produced that have excellent durability to impulses or external forces.

When the antenna coil of the embodiment is used as a data transmitting and receiving card antenna for a portable electronic key, space in the electronic key can be saved.

Furthermore, another preferred embodiment of the invention will be described referring to the figures.

FIGS. 5-8 show one embodiment of an antenna coil in accordance with the invention.

Figure 5:
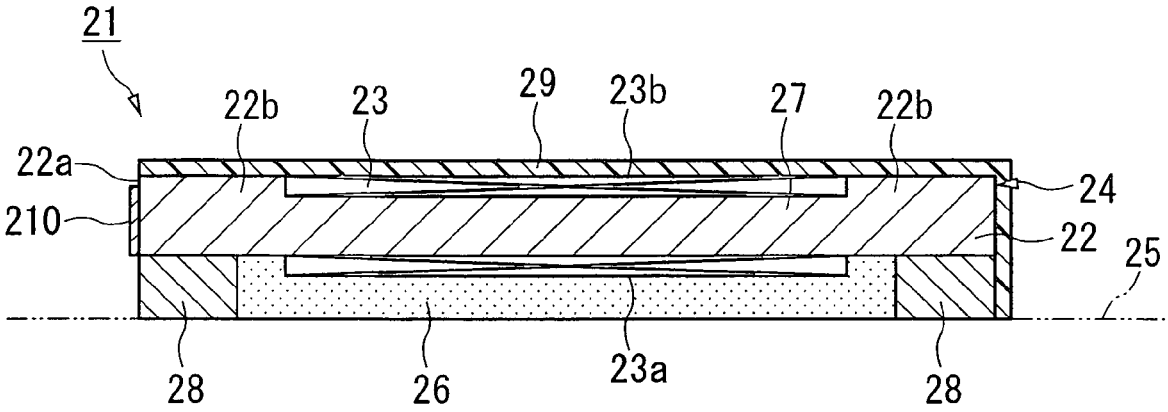
FIG. 5 is a cross-sectional view of one embodiment of an antenna coil in accordance with the invention.
Figure 6:
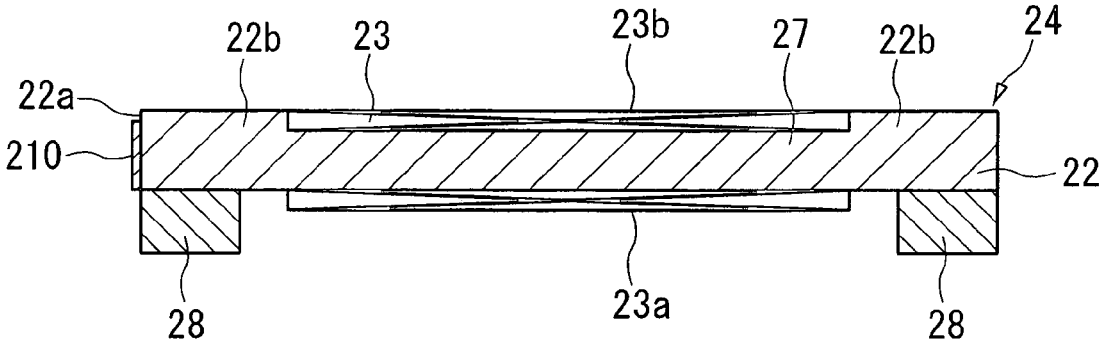
FIG. 6 is a cross-sectional view of an X Y coil unit of the antenna coil shown in FIG. 5.
Figure 7:
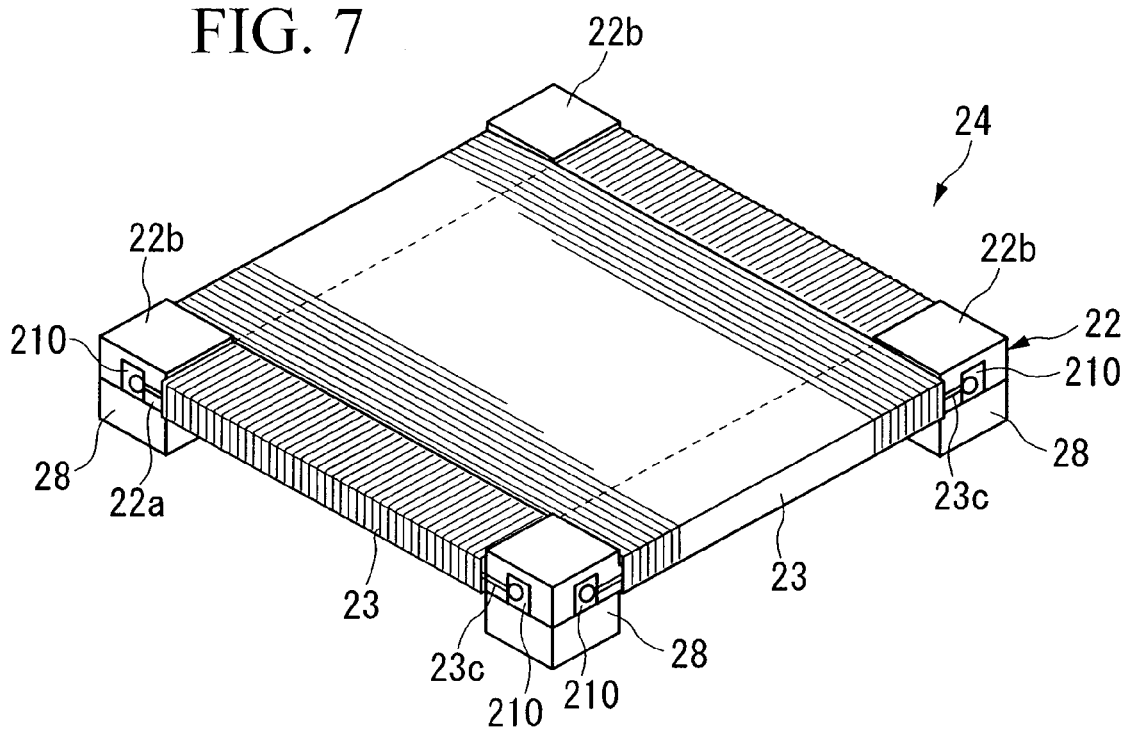
FIG. 7 is a perspective view of an X Y coil unit of the antenna coil shown in FIG. 5.
Figure 8:
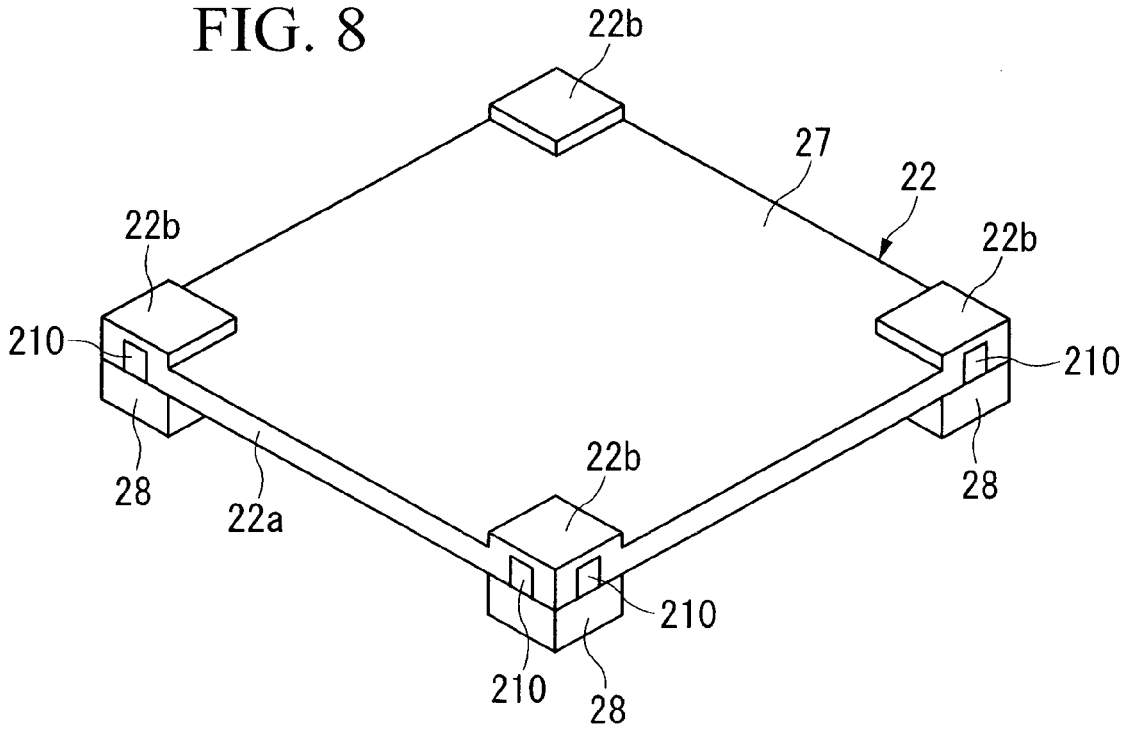
FIG. 8 is a perspective view of a-core of the antenna coil shown in FIG. 5.

FIG. 5 is a cross-sectional view of the embodiment of an antenna coil; FIG. 6 is a cross-sectional view of an X Y coil unit of the antenna coil; FIG. 7 is a perspective view of an X Y coil unit of the antenna coil; FIG. 8 is a perspective view of a core of the antenna coil.

As shown in FIG. 5, an antenna coil 21 includes an X-Y coil unit 24 where a coil 23 is wound around a core 22; a magnetic shield layer 26, made up of nonmetal magnetic powder, provided on a lower face 23*a* that is on the side of a print board 25 of the coil 23; and legs 28 provided lower than a portion 27 around which the coil 23 of the core 22 is wound (called "a coil wound portion" hereunder).

In addition, the antenna coil 21 of the present embodiment includes a coating film 29, by a resin powder coating, on an upper face 23*b* of the coil 23; and a terminal 210 for connecting an end 23*c* (refer to FIG. 7) of the coil 23 on a side 22*a* of the core 22.

As shown in FIGS. 6 and 7, the X-Y coil unit 24 includes the core 22, two coils 23 and 23 where conductors are wound in an orthogonal direction each other with respect to the coil wound portion 27 of the coil 22. The two coils 23 and 23 function as an X axis coil and a Y axis coil, respectively.

The antenna coil 21including two coils-the X axis coil and the Y axis coil-is shown in the figures as an example. Furthermore, a Z axis coil can be added that is wound in the orthogonal direction with respect to each of the X and Y axis coils. In this way, where the three coils composed of the X, Y and Z axis coils are placed so that the direction orthogonal to each other can be an axis, the three coils function as a non-directional three-axis antenna coil that can receive a signal in a three-dimensional arbitrary direction in order to produce a high reception sensitivity.

The core 22 of the present embodiment is solid and in the form of a flat plate (in detail rectangular) as shown in FIG. 8. The material of the core 22 may be a soft magnetic material such as ferrite or amorphous alloy. The upper sides of the four corners of the core 22 (when mounting an antenna coil, a surface that is on the side of the print board 25 is called a lower surface, and another surface opposite to the lower surface is called an upper surface) have each a projection 22*b*. The projections 22*b*, 22*b*, 22*b* and 22*b* can prevent the coils 23 and 23 wound around the coil wound portion 27 from slipping or coming off.

Even if a conductor (not shown) such as a wiring pattern or an electronic device formed on the printed board 25 is beneath the antenna coil 21, the magnetic shield layer 26 is provided on the lower surface 23*a* that is on the side of the printed board 25 of the coil 23 in order to control an decrease in an inductance of the coil and a value of Q Moreover, in place of the printed board 25, a single-layer (a single side) printed board or a multi-layered printed board can be applied.

The magnetic shield layer 26 is composed of nonmetal magnetic powder. As the nonmetal magnetic powder, ferrite such as Mg ferrite or Cu—Zn ferrite is preferable. The thickness of the magnetic shield layer 26, which is not particularly limited, can be adjusted to, for example, 1~5 mm. A method of fixing the magnetic shield layer 26 to the lower surface 23*a* of the coil 23 is explained in, by way of example, items (1) and (2) described below.

(1) A method of using a compound that is derived by mixing nonmetal magnetic powder with adhesive resin such as silicon resin and epoxy resin.

According to this method, adhesive resin is chemically hardened or fused by heating to about 200~300° C. The adhesive resin in the present embodiment functions as combining nonmetal magnetic powder and as adhering the derived magnetic shield layer 26 to the lower surface 23*a* of the coil 23.

(2) A method of self-fusing nonmetal magnetic powder that is resin-coated so as to own self fusing film.

As magnetic powder having self fusing film, for example, magnetic powder is used where film showing self fusing film by heating is formed uniformly thin on an outer surface of magnetic powder such as ferrite. As the self fusing film, thermo plastic resin having a heat melting characteristic such as epoxy resin, acryl resin, enamel, and polyurethane resin can be utilized. When self fusing film is provided, particles of magnetic powder can be self-fused by heating to, for example, 200~500° C. In addition, it is unnecessary to apply pressure when performing self-fusion; instead normal pressure can be used. The self-fusion film in the present embodiment functions as combining nonmetal magnetic powder and as adhering the derived magnetic shield layer 26 to the lower surface 23*a* of the coil 23.

It is preferable that the thickness of the self-fusing film is below 1 μm. On account of this, the ratio of magnetic powder in the magnetic shield layer 26 is increased to produce more excellent effects by the magnetic shield. Preferably, the radius of magnetic powder particles is 50~200 μm. Self-fusing the nonmetallic magnetic powder having this type of self-fusing film can form the outstanding magnetic shield layer 26.

As in the methods described in items (1) and (2), forming the magnetic shield layer 26 by adding resin for combining the nonmetallic magnetic powder can reduce working steps or cost for forming the magnetic shield layer 26. In addition, since the nonmetallic magnetic powder can be fixed serving to adhere the coil 23 to the magnetic shield layer 26, closeness of the windings of the coil 23 increases so that the windings avoid becoming loose.

Compounding ration of the adhesive resin to the nonmetallic magnetic powder and filling quantity of the magnetic shield layer 26 with respect to the lower surface 23*a* of the coil 23 can be adjusted to a certain extent. Adjusting the Compounding ration and the filling quantity can adjust the inductance of the coil 23.

On the other hand, in order to good magnetic shield effects, sintering magnetic materials can be considered to be used for metallic magnetic materials in place of the nonmetallic magnetic powder. When these materials are used to form a magnetic shield layer, it is additionally necessary to fix the magnetic shield layer on the lower surface of the coil, which increases working steps or cost. In particular, using a metallic magnetic material lowers the value of the inductance, which is an adverse effect.

The leg 28 is projected downward from the coil winding portion 27 of the core 22 in order to support the coil winding portion 27 of the core 22 on the printed board 25. The leg 28 can be integrally formed with the core 22 using the same material as that of the core 22, or can be separately formed from the core 22. When the leg 28 is separately formed from the core 22, the leg 28 is composed of nonconductor (electric insulator).

The materials for forming the leg 28 can be, for example, a plastic or a nonconductive magnetic material such as ferrite that is the same as the core 22.

In this way, providing the leg 28 secures the distance between the coil winding portion 27 and the printed board 25 that is only the length of the leg 28. Accordingly, the distance (gap) from the conductor (not shown) such as the wiring pattern or electronic devices on the printed board 25 to the coil 23 is secured to control a decrease in antenna sensitivity.

The coating film 29 is provided by resin powder coating on the upper surface 23*b* of the coil 23. In this way, providing the coating film 29 by resin powder coating as an outer covering, which covers the upper surface 23*b* of the coil 23, can protect the coil 23 and realize that the outer covering is made thinner. An example of the coating film 29 is that the coating film 29 having a thickness of 0.1~15 mm is formed using resin powder of a particle radius of about 50~70 μm composed of epoxy resin.

In the resin powder coating, without using solvent such organic solvent or water, 100% solid resin powder (solid body) is used to coat by well-known technique. That is, after attaching resin powder to a predetermined portion of the antenna coil 21, the coating film 29 is burned by heating to adhere closely to the coil 23. Using the coating film 29 by resin powder coating increases adherence of the windings of the coil 23 and avoids becoming loose. When comparing the coating film 29 with general molding resin such as ABS and polycarbonate, a hard and heat resist temperature outer covering can be easily obtained.

On the side surface 22*a*, the terminal 210 where the end 23*c* of the coil 23 is connected is provided.

It is preferable that the terminal 210 is formed by a gold plating layer. Forming the terminal 210 by plating realizes that the terminal is miniaturized and made thinner.

In the plating, for example, making nickel (Ni) a substrate, thickness of about 5 μm can be formed.

When this antenna coil 21 is used as a data transmitting and receiving card antenna of a portable electronic key, the antenna coil 21 is buried in an IC card for use together with a control unit that also serves for a store unit for storing an ID code signal characteristic of a vehicle.

Moreover, an electronic key system for a vehicle utilizing the data transmitting and receiving card antenna includes an antenna coil 21 of the present invention, as a data transmitting and receiving card antenna, in an IC card as an electronic key, and includes an antenna coil that is electromagnetically coupled to the data transmitting and receiving card antenna of the IC card in a card reader on a vehicle (a transceiver on an external side). When a distance between the vehicle and the IC card are within a predetermined range, an inquiry signal from the antenna coil of the card reader on the vehicle is transmitted as an electromagnetic induction signal that is an air propagating signal.

At this time, electric power for driving the IC card is also sent from the vehicle to the IC card. When the inquiry signal is received by the data transmitting and receiving card antenna for the IC card, an ID code signal, which is stored in the control unit of the IC card, characteristic of the vehicle, is transmitted as an electromagnetic induction signal that is an air propagating signal, as a response signal from the data transmitting and receiving card antenna.

The card reader reads the ID code transmitted by the IC card, and compares the ID code read in with an ID code stored beforehand on the vehicle side. When both agree, some operations such as locking and/or unlocking a door or starting up an engine are supposed to be performed.

The method of manufacturing the antenna coil 21 of the present embodiment will be described hereinbelow. First, as shown in FIG. 8, the core 22 having the terminals 210 and the legs 28 are prepared. By winding the coil 23 and 23 in the two directions orthogonal with respect to the core 22, the X-Y coil unit 24 shown in FIG. 7 is formed.

The end 23*c* of the coil 23, as shown in FIG. 7, is pulled up on the terminal 210 formed on the sides 22*a* of the core 22 to be connected with the terminal 210 by, for example soldering. The solder used for connecting the terminal 210 with the end 23*c* of the coil 23 should have heat resisting property that can be durable to the temperature of heat processing when the magnetic shield layer 26 and the coating film 29 are formed.

Next, the magnetic shield layer 26 is formed on the lower surface 23*a* of the coil 23. The magnetic shield layer 26 can be formed by, for example, the following method. The X-Y coil unit 4 is put into a metal mold. Nonmetallic magnetic powder having self-fusing film or compound composed of nonmetallic magnetic powder and adhesive resin is filled into a gap between the lower surface 23*a* of the coil 23 and the metal mold to heat.

Furthermore, as shown in FIG. 5, the coating film 29 is formed by resin powder coating so that the upper 23*b* of the coil 23 is covered. The terminals 210 are exposed outside of the coating film 29 in order to connect the antenna coil 21 with an external circuit.

Following the above steps, the antenna coil 21 of the present embodiment can be manufactured.

As explained above, according to the antenna coil 21 of the present embodiment, even if conductors such as electronic components or wiring pattern formed on the printed board 25 exist below the antenna coil 21, the magnetic shield layer 26 composed of nonmetallic magnetic powder provided on the lower surface 23*a* of the coil 23 controls the lowering of the inductance of the coil and the value of Q. Because of this, maintaining antenna sensitivity, a mounting area for the antenna coil 21 on the printed board 25 can be reduced.

Since the antenna coil 21 of the present embodiment includes the legs 28 that are lower than the coil wound portion 27 of the coil 22 and support the core 22 on the printed board 25, the distance between the coil wound portion 27 and the printed board 25 can be obtained by the length of the leg 28. Accordingly, the distance (gap) to the coil 23 from the conductor such as wiring pattern on the printed board 5 or an electronic component controls a decrease in the antenna sensitivity.

Since the antenna coil 21 of the present embodiment includes the coating film 29 by resin powder coating as an outer covering of the coil 23, the oil 23 can be protected, and, at the same time, the outer covering can be made thinner.

Since the antenna coil 21 of the present embodiment includes the terminal 210 formed by a metallic plate layer as a terminal to which the end 23*c* of the coil 23 is connected, the terminal 210 can be made smaller and thinner.

The invention can be applied to an antenna coil that is used for, for example, a keyless entry system (an electronic key system) for vehicles and an IC card.

While preferred embodiments of the invention have been described and illustrated above, it should be understood that these are only exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. An antenna coil comprising:

an X Y coil unit having an X axis coil and a Y axis coil wound around a core;

a Z coil having a hollow portion and wound around the X Y coil unit, wherein the X Y coil unit is held in the hollow portion of the Z axis coil and spaced apart from the Z axis coil; and a resin portion which is insert-molded to surround and enclose both the X Y coil unit and the Z axis coil for integrating the X Y coil unit and the Z axis coil;

wherein the X axis coil, the Y axis coil, and the Z axis coil are arranged so that the-three coils each has an axis in a direction orthogonal to each other.

2. The antenna coil as recited in claim 1, further comprising electrodes connected to each terminal of the three coils and fixed by being insert molded on the resin portion wherein a portion of each electrode is exposed outside the resin portion.

3. The antenna coil as recited in claim 1, wherein the Z axis coil is fixed in the resin portion to the X Y coil unit by an adhesive.

4. The antenna coil as recited in claim 2, wherein the Z axis coil is fixed in the resin portion to the X Y coil unit by an adhesive.

* * * * *